US006155180A

United States Patent [19]

Clark

[11] Patent Number: 6,155,180

[45] Date of Patent: Dec. 5, 2000

[54] COMPUTER TABLE

[76] Inventor: Rodney D. Clark, 212 2nd East, Egan, S. Dak. 57028

[21] Appl. No.: 09/330,209

[22] Filed: Jun. 11, 1999

[51] Int. Cl.[7] ..... A47B 37/00

[52] U.S. Cl. ..... 108/50.02; 108/26; 312/223.6; 312/223.3

[58] Field of Search ..... 108/50.01, 50.02, 108/25, 26; 312/223.1, 223.3, 223.6, 194, 197, 223.2

[56] References Cited

U.S. PATENT DOCUMENTS

| | | | |
|---|---|---|---|
| 3,856,371 | 12/1974 | Forsyth | 108/26 X |
| 4,066,305 | 1/1978 | Gazarek | 312/223.3 X |
| 4,654,756 | 3/1987 | Wilson et al. | 312/223.3 X |
| 4,766,422 | 8/1988 | Wolters et al. | 312/223.3 X |
| 5,071,204 | 12/1991 | Price et al. | 312/223.3 X |
| 5,130,494 | 7/1992 | Simonton et al. | 312/223.1 X |
| 5,231,562 | 7/1993 | Pierce et al. | 312/194 X |
| 5,452,950 | 9/1995 | Crenshaw et al. | 312/223.6 X |
| 5,587,877 | 12/1996 | Ryan et al. | 312/223.2 X |
| 5,680,820 | 10/1997 | Randolph | 312/223.3 X |
| 5,825,615 | 10/1998 | Ohara | 312/223.3 X |
| 5,897,179 | 4/1999 | Wade | 108/50.02 X |
| 6,076,473 | 6/2000 | Conte | 312/223.2 X |

FOREIGN PATENT DOCUMENTS

| | | | |
|---|---|---|---|
| 0084622 | 5/1985 | Japan | 312/223.3 |

*Primary Examiner*—Peter M. Cuomo
*Assistant Examiner*—Hanh V. Tran
*Attorney, Agent, or Firm*—Zarley, McKee, Thomte, Voorhees & Sease

[57] ABSTRACT

A system of mounting a computer mechanism to avoid tangled cords and to protect the equipment conveniently within a desk or similar work surfaces. The system includes a desk having units of the computer and a harness of the wires and cables necessary for operation thereof either built into the desk or added to the desk.

7 Claims, 2 Drawing Sheets

COMPUTER TABLE

BACKGROUND AND SUMMARY OF THE INVENTION

This invention pertains to the installation of computer units in desks or similar platforms where the confusion of multiple wires and cords are minimized as opposed to installations in which power cables, network cables and other similar wires are indiscriminately run from one unit to another with the net result of a good deal of confusion and entanglement of cords.

The relatively recent advent of personal computers at multiple locations throughout an office with the computers net-worked together by cables, each computer including a power cord, monitor, power and signal connections and cords for a mouse, key board, and printer, as well as from a central processing unit has resulted in installation on the floor or on desks or in cubicles with severely jumbled cables and cords either behind the desk or under or alongside the desk. The result is both an unsightly entanglement of wires and difficult repair or replacement circumstances in which wires and cables must be sorted out and traced through the tangle so that the correct wire or cable may be handled for the replacement.

Also, the placement of the processing unit on the floor is frequently difficult to access. Usually it is desirable to get the box out of the way, but that leads to a condition of inaccessibility when service or repair is necessary. Frequently, in such situations, furniture must be moved or sometimes even dismantled in order to get at the interior of the container in which the electronics are located.

By the present invention an installation may be made in which the cable can be run to a given point at which computer components may be located while at the same time, the cable is enclosed systematically within a desk corridor or component. Some individual separation of computer components maybe indicated for more convenient installation of the computer both for convenience, cleanliness and security if desired, these components maybe retractable into separate compartments. The convenience of ready access will be obvious. It may also be apparent that security may be enhanced by the easy provision of locked containers for the processor especially.

It is also apparent that by this invention, added protection to the processing unit is available because of improved location away from a position of being bumped or kicked on the floor. Further the improved location of the processor farther from the drives provides for better cooling and improved circulation of air around the processor. Dust prevention for both the processor and the drives is also enhanced.

DESCRIPTION

Figure 1:
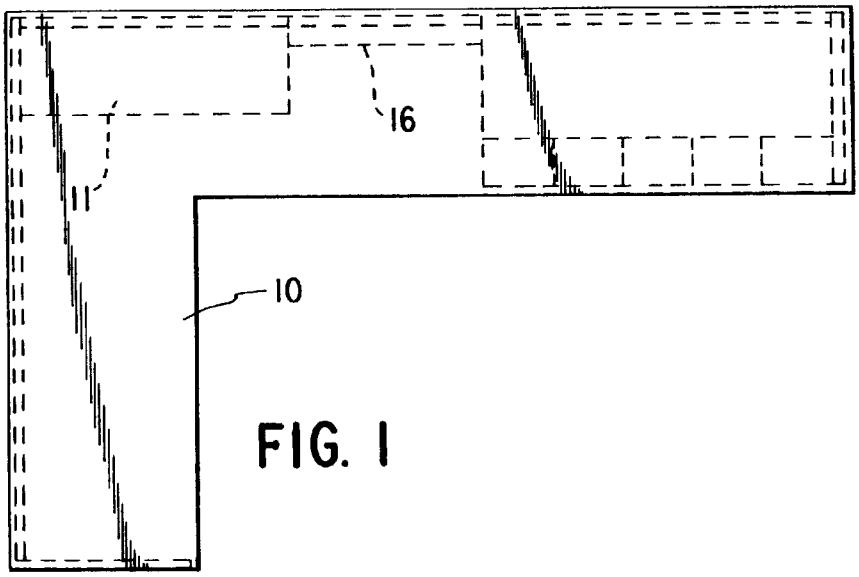
FIG. 1 is a top plan view of a desk incorporating the system of the invention.
Figure 2:
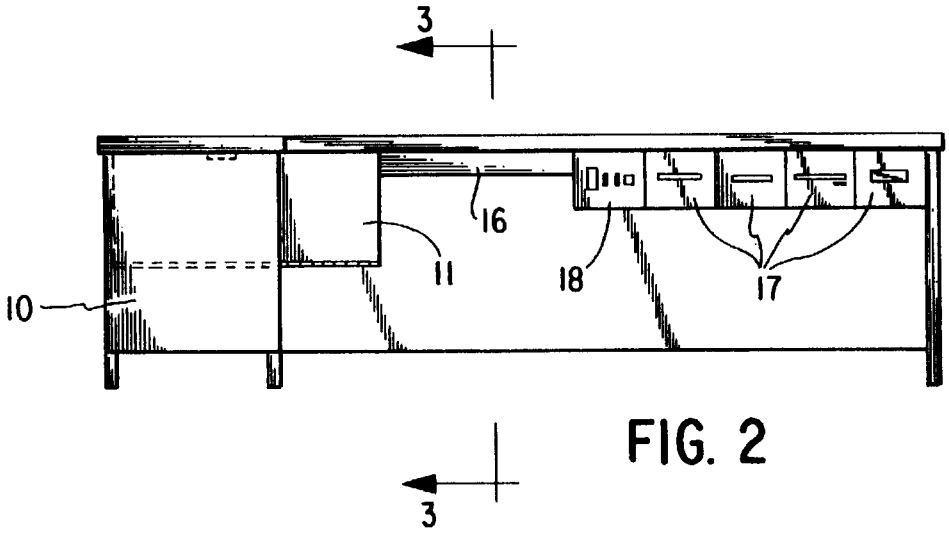
FIG. 2 is a front elevational view of the desk of FIG. 1.
Figure 3:
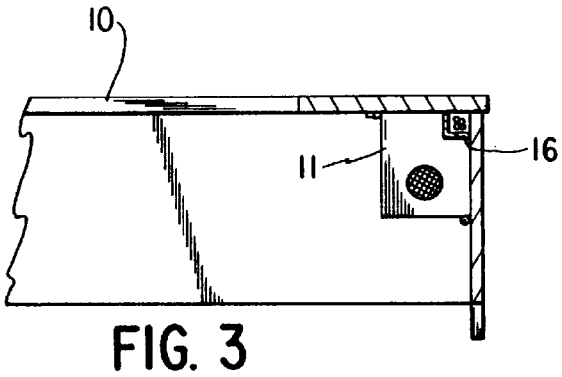
FIG. 3 is a sectional view from line 3—3 of FIG. 2.

Briefly the invention comprises a system for providing necessary wiring arrangements for a computer in connection with a desk. The computer does not necessarily become part of the desk, but various components may be separately located on the desk.

More specifically and with reference to the drawings, the system is used in connection with a desk 10 or other computer platform which typically would be an L-shaped device adapted to be placed in a corner of an office or work cubicle. Computers are often set on such desks and trail electrical cords or cables to other networked computers or to electrical outlets or to other components of the computer—all of which leads to a tangle or jumble of cords and wires which must be traced or untangled when components are to be repaired or replaced.

In the current device, the desk includes a specific container 11 for the central processor. This container is preferably hinged to the rear part of the desk at a lower corner 12 of the container. Thus, a server or a processing unit can be carried within this container 11 and tipped forward for renewal or replacement when necessary. It is obvious that a drawer or slide arrangement might be readily substituted for the hinged container.

Cables and cords 15 from this unit are threaded through a conduit 16 and from this conduit may lead to a monitor (not shown) on the top of the desk and to a power source (also not shown), or perhaps to a printer. Principally, however, the cables are designed to lead to the disk drive units 17 and a control panel unit 18. These units maybe mounted by any convenient device to the lower surface of the desk top at a conveniently accessible location. The conduit 16 is preferably built into the desk at an upper rear corner so as to be out of the way. Thus, the wires and cables are all contained in a location where they will not be tangled and will not get underfoot.

Figure 4:
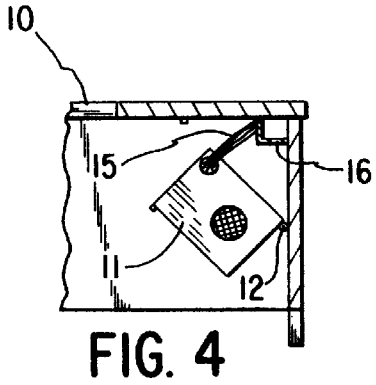
FIG. 4 is a partial view similar to FIG. 3 showing the processor container in an open position.

As shown in FIG. 4, some excess cable and wires maybe required in order to tilt down the container 11. Provision is made for storage of those short excess amounts within that container. Thus, as the container 11 is returned to its upper or closed position that excess can be tucked into the container to get the cords out of the way. It will be obvious to those skilled in the art that a drawer or similar container could be substituted for the hinged arrangement shown in the figures.

Figure 5:
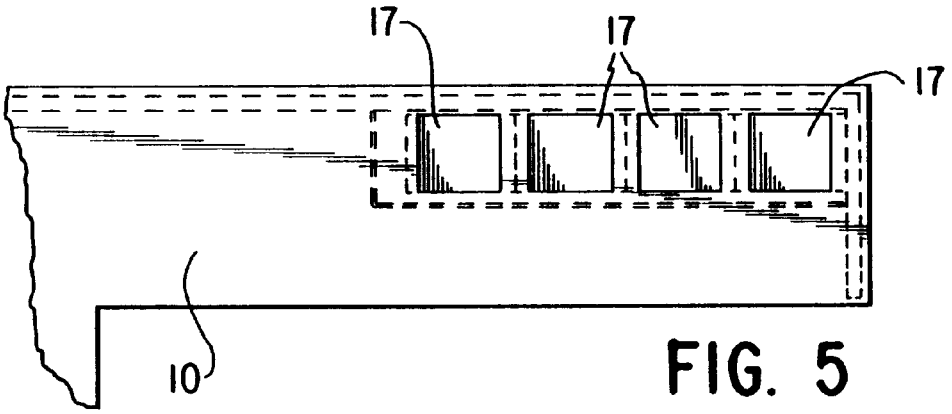
FIG. 5 is a partial top plan view of an alternative type desk.
Figure 6:
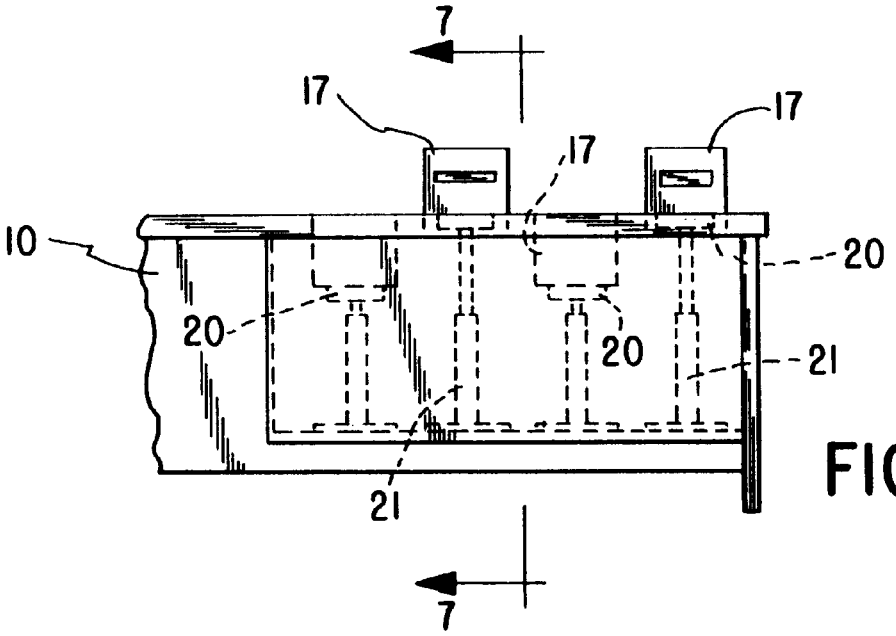
FIG. 6 is a front elevational view of the alternative shown in FIG. 5.
Figure 7:
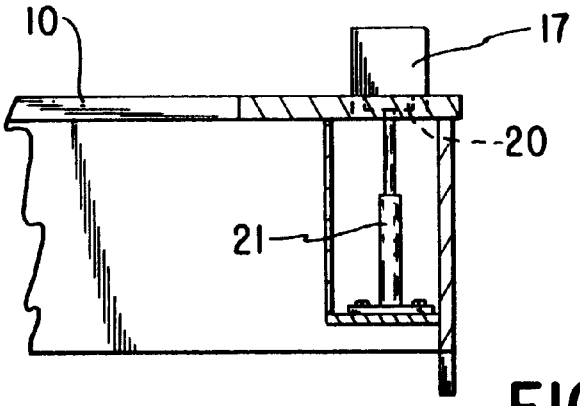
FIG. 7 is a sectional view from line 7—7 of FIG. 6.

An alternative embodiment of the system is shown in FIGS. 5–7. In this embodiment, the cords and wires to the processing unit and its container 11 are handled in the same way. However, the disk drives 17 instead of being mounted on the front edge of the desk 10 are separately mounted on platforms 20. Each platform is mounted so that it can be raised or lowered by some kind of elevator unit. Illustrated is a piston and cylinder device 21 which may be operated hydraulically or pneumatically. However, electrically operated devices, cable and pulley devices, or any other mechanisms may be used to provide the lifting. This mechanism provides convenient compact means for hiding the drives so that they will not interfere in any way with the use of the desk. It will be apparent that by mounting these lifts 20 and the drive units 17 at the rear of the desk, and by making the top of the drive unit fit the opening in the desk so that the unit can be lowered to be flush with the desk surface, the use of the desk is not interfered with.

Suitable security devices of any acceptable type may be used on the controls of the lifts so that unauthorized use of the device may be avoided.

It is apparent that by this invention a compact and convenient installation of a computer on a desk may be provided. The installation will be not only be compact and convenient but can be easily accessed for repair and replacement, and will be relatively secure physically.

What is claimed is:

1. A system for mounting the components of a computer device, said system comprising:

a desk having a top with an upper surface and a lower surface, a front edge and a rear edge, a container for holding the processing unit of said computer device, a hinge on said container hingedly mounting said container on said desk below said desk top and near its rear edge, a support housing for supporting disk driver components of said computer device mounted to said desk, and a conduit extending from said container to said support housing for carrying a grouping of connecting wires from said container to the support housing, wherein the container is pivotable between closed and open positions for easy access to the interior of the container.

2. The system of claim 1 in which said support housing include lift devices for each disk drive component to raise said disk drive component above the upper surface of said desk.

3. A computer desk for supporting the processing component and the disk drive components of a computer, said desk having a top with an upper surface and a lower surface, said top also having a front edge and a rear edge, comprising:

a container for holding said processing component, a hinge on said container hingedly mounting said container on said desk below said desk top and near its rear edge, a support housing mounted to said desk for supporting said disk drive components, and a conduit extending from said container to said support housing for carrying wires and cables between said container and said support housing, wherein the container is pivotable between closed and open positions for easy access to the interior of the container.

4. The desk of claim 3 in which said support housing is positioned beneath said lower surface near the front edge of said top.

5. The desk of claim 3 in which said support housing has lift devices for raising said disk drive components above said upper surface of said desk.

6.The desk of claim 3 in which, in said closed position, said container engages the lower surface of said desk top near the rear edge.

7. The desk of claim 3 in which said support housing is mounted to said desk at a position remote to said container.

* * * * *